US010342327B2

(12) United States Patent
Lin et al.

(10) Patent No.: US 10,342,327 B2
(45) Date of Patent: Jul. 9, 2019

(54) DEVICE FOR TABLE ELEVATION

(71) Applicants: Yu-Chen Lin, Tainan (TW); Tung-Yi Lin, Tainan (TW)

(72) Inventors: Yu-Chen Lin, Tainan (TW); Tung-Yi Lin, Tainan (TW)

( * ) Notice: Subject to any disclaimer, the term of this patent is extended or adjusted under 35 U.S.C. 154(b) by 0 days.

(21) Appl. No.: 15/963,282

(22) Filed: Apr. 26, 2018

(65) Prior Publication Data

US 2019/0174913 A1 Jun. 13, 2019

(30) Foreign Application Priority Data

Dec. 12, 2017 (TW) ..... 106143581 A

(51) Int. Cl.
*A47B 9/20* (2006.01)
*A47B 96/20* (2006.01)

(52) U.S. Cl.
CPC ..... *A47B 9/20* (2013.01); *A47B 96/20* (2013.01); *A47B 2200/0062* (2013.01)

(58) Field of Classification Search
CPC .... A47B 9/20; A47B 9/08; A47B 9/04; A47B 9/00; A47B 2200/0051; A47C 3/40
USPC ..... 248/188.2, 188.5; 108/148, 147.19, 147, 108/144.11
See application file for complete search history.

(56) References Cited

U.S. PATENT DOCUMENTS 3,521,341 A * 7/1970 Hornlein ..... A47B 9/20 248/161
3,887,155 A * 6/1975 Bertalot ..... F16B 7/10 248/333
4,667,605 A * 5/1987 Bastian ..... A47B 9/20 108/106
6,345,547 B1 * 2/2002 Stoelinga ..... A47B 9/06 108/147
6,595,144 B1 * 7/2003 Doyle ..... A47B 9/00 108/147
7,559,516 B2 * 7/2009 Koder ..... A47B 9/04 108/147
9,743,755 B2 * 8/2017 Lin ..... B66F 3/26
10,107,448 B1 * 10/2018 Hung ..... A47B 9/20
2002/0050112 A1 * 5/2002 Koch ..... A47B 9/20 52/651.07
2003/0033963 A1 * 2/2003 Doyle ..... A47B 9/04 108/147.19

(Continued)

FOREIGN PATENT DOCUMENTS

TW M461623 U1 9/2013

*Primary Examiner* — Jose V Chen
(74) *Attorney, Agent, or Firm* — Rosenberg, Klein & Lee

(57) ABSTRACT

A device for table elevation includes: two decorative covers; two guiding bases connected by a connecting rod and each having four fixed sides; plural guide bearings provided in pairs, each pair arranged opposite, and at an angle with respect to, each other; two guide posts having plural guided sides corresponding in number and position to the fixed sides, the guided sides being in contact with the guide bearings so that the guide posts can slide with respect to the guiding bases respectively, the guide bearings abutting against the guided sides in the aforesaid pairs; two driving units each including an elevating rod; and a tabletop with a guide post fixing base fixed at the top ends of the guide posts and of the elevating rods so as to move vertically with the elevating rods and the guide posts while the decorative covers and the guide posts stay vertical and stable.

10 Claims, 8 Drawing Sheets

(56) References Cited

U.S. PATENT DOCUMENTS

| | | | | |
|---|---|---|---|---|
| 2012/0043436 | A1* | 2/2012 | Atkinson | A47B 9/20 248/188.5 |
| 2013/0293173 | A1* | 11/2013 | Strothmann | A47B 9/20 318/466 |
| 2014/0360415 | A1* | 12/2014 | Riis | A47B 9/20 108/147.19 |
| 2015/0047538 | A1* | 2/2015 | Ergun | A47B 9/02 108/147 |
| 2015/0164218 | A1* | 6/2015 | Bonuccelli | A47B 9/20 108/147.19 |
| 2016/0281912 | A1* | 9/2016 | Christen | F16M 11/26 |
| 2016/0331619 | A1* | 11/2016 | Revenus | A47B 9/20 |
| 2017/0188698 | A1* | 7/2017 | Chen | A47B 91/02 |
| 2017/0238697 | A1* | 8/2017 | Randlov | A47B 9/20 |
| 2018/0064241 | A1* | 3/2018 | Tseng | A47B 9/10 |
| 2018/0172062 | A1* | 6/2018 | Hu | A47B 9/04 |
| 2018/0303233 | A1* | 10/2018 | DeGroot | A47B 9/20 |

* cited by examiner

DEVICE FOR TABLE ELEVATION

BACKGROUND OF THE INVENTION

1. Technical Field

The present invention relates to an ergonomic elevating structure that will move stably without tilting whenever it is vertically adjusted.

2. Description of Related Art

Nowadays, tables generally have fixed and nonadjustable heights. Such a limitation in height, however, greatly reduces the practical value of tables and does not meet ergonomic requirements. In view of this, the applicant of the present invention developed an elevating device for adjusting the height of a tabletop arbitrarily, as disclosed in Taiwan Utility Model Patent No. M461623, granted on Sep. 11, 2013 and entitled "Elevating Device", in which the elevating device includes an upper base, a pneumatic rod mounted beneath the upper base, two supporting rods extending downward from the upper base, and a lower base for receiving the pneumatic rod and the two supporting rods. Each of the supporting rods has a peripheral surface, at least one collar mounted around the peripheral surface, and a plurality of balls movably provided in the collar and lying against the peripheral surface. The lower base has a vertical pedestal, a through hole that penetrates the vertical pedestal and in which the pneumatic rod is fixedly provided, and two sleeves that are provided in the vertical pedestal and into which the two supporting rods extend respectively. Each sleeve has an inner surface, against which the balls of the corresponding supporting rod lie. The two supporting rods help the pneumatic rod support an external object so that the external object will move stably while being lifted or lowered. The balls add to the stability of movement by allowing the two supporting rods to slide smoothly upward and downward in the two sleeves respectively.

Nevertheless, the assembly of the aforesaid elevating device is complicated and time-consuming because the elevating device requires a plurality of collars to be mounted around and along the peripheral surface of each supporting rod at intervals and a plurality of balls to be movably mounted in each collar. Moreover, as the balls lie against, or more particularly are in point contact with, the peripheral surfaces of the supporting rods and the inner surfaces of the sleeves, not only is each contact point under great pressure, but also the elevating device is bulky as a whole. In addition, when the elevating device is used with an elliptic tabletop, the cylindrical moving rods do not match the elliptic shape of the tabletop esthetically. The elevating device, therefore, leaves much to be desired.

The applicant subsequently improved the elevating device and was granted therefor U.S. Pat. No. 9,743,755 on Aug. 28, 2017. The improved elevating device includes a driving unit, a moving tube, and a rolling unit. The driving unit includes an activating shaft having one end connected to an external object, a sleeve fixed around the activating shaft and having at least two axially extending flat surfaces, an activating cylinder provided at the opposite end of the activating shaft and configured for driving the activating shaft into telescopic movement with respect to the sleeve, and a controlling member connected to the activating cylinder and configured for controlling the activating cylinder. The moving tube is mounted around the sleeve and has one end connected to the bottom side of the external object. The moving tube is driven upward or downward by the activating shaft while the activating shaft is moved telescopically with respect to the sleeve. The rolling unit includes a plurality of rollers that are rotatably attached to the moving tube and maintain contact with the flat surfaces of the sleeve. Thus, the improved elevating device can lift and lower the external object stably.

Referring to FIG. 8, the sleeve (A) of the improved elevating device has a regular hexagonal cross-section and hence six axially extending flat surfaces (A1). The moving tube (B) has a regular hexagonal cross-section and six inner wall surfaces (B1) that correspond respectively to the six flat surfaces (A1). Three rolling units (C) are each provided on every other inner wall surface (B1) of the moving tube (B) to enable relative movement of the sleeve (A) and the moving tube (B). When it is desired to lift or lower the external object, e.g., a tabletop, the activating shaft (D) of the driving unit can be made to extend or retract and thereby drive the moving tube (B) upward or downward so that, with both the top end of the activating shaft (D) and the top end of the moving tube (B) connected to the tabletop (not shown), the tabletop can be adjusted in height. After using this improved elevating device for some time, however, the applicant found that providing the regular hexagonal moving tube (B) with only three rolling units (C) creates gaps, and consequently the possibility of unintended movement, between those flat surfaces (A1) that are not provided with any rolling unit (C) and the corresponding inner wall surfaces (B1). When the tabletop is adjusted to a certain height, therefore, the moving tube (B) may tilt toward any of the gaps if the tabletop is loaded unevenly or too high. Besides, the improved elevating device is also disadvantaged by bulkiness and potential failure to match the external object esthetically.

BRIEF SUMMARY OF THE INVENTION

In light of the aforementioned drawbacks of the conventional table-elevating structures, the present invention provides a device for table elevation that includes two decorative covers, two guiding bases, a plurality of guide bearings, two guide posts, two driving units, and a tabletop. The two decorative covers are provided opposite each other. The two guiding bases are fixed in the two decorative covers respectively and each have at least four fixed sides, and there is a connecting rod between the two guiding bases. The plural guide bearings are fixed on the fixed sides of the two guiding bases respectively and are provided in pairs, wherein each pair of guide bearings are arranged opposite, and at an angle with respect to, each other. The two guide posts are placed in the two guiding bases respectively and each have a plurality of guided sides corresponding in number and position to the fixed sides of the corresponding guiding base. The guided sides are in contact with the guide bearings so that the two guide posts can be slid with respect to the two guiding bases respectively. In addition, the guide bearings abut against the guided sides in the aforesaid pairs, i.e., each pair being arranged opposite, and at the aforesaid angle with respect to, each other. The two driving units are fixed in the two guide posts respectively and are each provided with an elevating rod. The tabletop is fixed at the top ends of the two guide posts and of the two elevating rods and therefore can be moved upward and downward simultaneously with the two elevating rods and the two guide posts.

The connecting rod is transversely fixed between two opposing sides of the two guiding bases.

Each of the two decorative covers forms a first receiving groove therein. The two guiding bases are provided in the two first receiving grooves respectively and are fixed on two table feet respectively. Each of the two guiding bases is mounted with a dust-proof cover for sealing the first receiving groove of the corresponding decorative cover.

Each of the two guiding bases has an elongated octagonal cross-section, whose four alternate sides are defined as the four fixed sides.

Each of the two guiding bases forms a second receiving groove therein, and the two guide posts are placed in the two second receiving grooves respectively.

The angle is an acute angle.

Each of the two guiding bases is fixedly provided with eight guide bearings, which are divided into an upper row of four guide bearings and a lower row of four guide bearings. The guided sides of each guide post are in contact with the upper row of four guide bearings and the lower row of four guide bearings of the corresponding guiding base.

The guide bearings are made entirely of metal, or are made entirely of plastic, or each have a metal outer portion and a plastic inner portion.

Each of the two guide posts is an extruded aluminum member, whose outer surface has an electrophoresis-based crystalline coating finish.

Each of the two guide posts forms a third receiving groove therein, and the two driving units are provided in the two third receiving grooves respectively and are fixed on two table feet respectively.

The technical features stated above have the following advantages:

1. With the connecting rod transversely fixed between the two opposing sides of the two guiding bases, the two guiding bases will stay vertical and stable without tilting.

2. The guided sides of each guide post are configured to slide along the two rows of guide bearings of the corresponding guiding base so that the two rows of guide bearings can support an upper area and a lower area of the guide post to keep the guide post vertical and stable while the guide post is being lifted or lowered.

3. With the guide bearings provided in pairs and abutting against the guided sides in pairs, and with each pair of guide bearings arranged opposite each other and at the aforesaid angle with respect to each other, the generation of unwanted gaps is avoided to prevent the guide posts from wobbling or getting loose with respect to the guiding bases during an upward or downward sliding process. Furthermore, the guide bearings are protected from uneven force application (e.g., force application on only one side) so that frictional resistance and damage of the guide bearings are circumvented.

4. With the guide bearings made entirely of metal or plastic or each having a metal outer portion and a plastic inner portion, noise resulting from gliding contact is reduced.

5. The electrophoresis-based crystalline coating finish of the outer surfaces of the guide posts can reduce oxidation and protect the guide posts from being scratched by gliding contact with the guide bearings, thereby enhancing the guide posts esthetically and extending the service life of the guide posts.

6. The elongated octagonal cross-sections of the two guiding bases render the device for table elevation visually pleasing, esthetically suitable for tabletops of different shapes, and ergonomic.

DETAILED DESCRIPTION OF THE INVENTION

Figure 1:
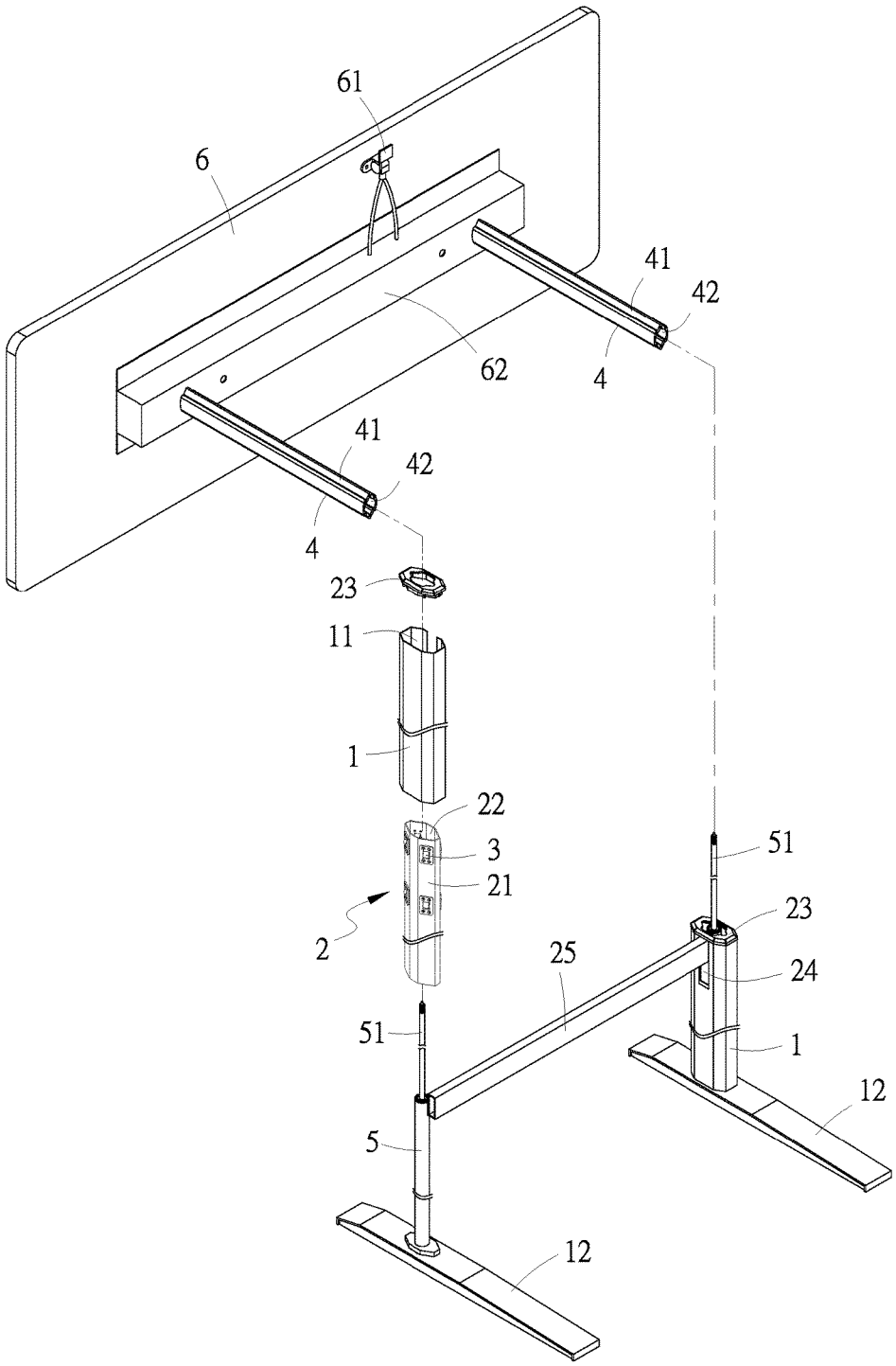
FIG. 1 is an exploded perspective view of an embodiment of the present invention.
Figure 2:
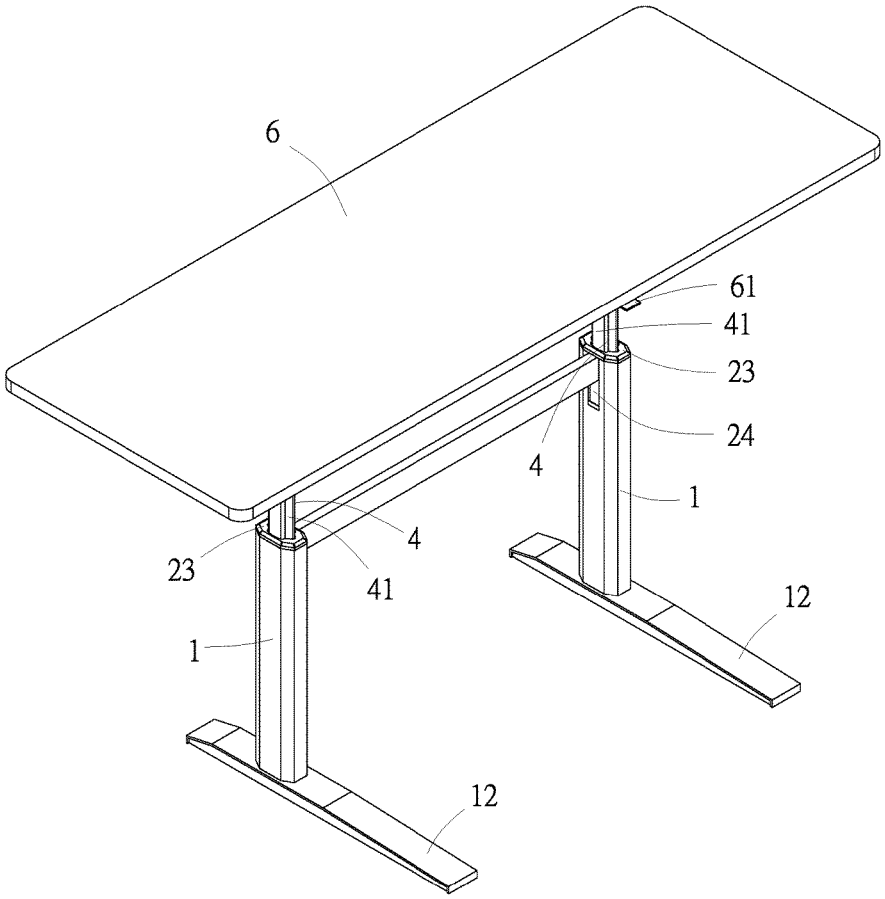
FIG. 2 is an assembled perspective view of the embodiment in FIG. 1.

Referring to FIG. 1 and FIG. 2, one embodiment of the present invention includes two decorative covers 1, two guiding bases 2, a plurality of guide bearings 3, two guide posts 4, two driving units 5, and a tabletop 6.

The two decorative covers 1 are provided opposite each other. Each decorative cover 1 has a tubular shape, forms a first receiving groove 11 therein, and has a bottom portion provided with a table foot 12.

The two guiding bases 2 are provided in the two first receiving grooves 11 of the two decorative covers 1 respectively and are fixed on the two table feet 12 respectively. Each guiding base 2 has an elongated octagonal cross-section (as can be seen more clearly in FIG. 3), of which four alternate sides are defined as fixed sides 21. Each guiding base 2 is also tubular and forms a second receiving groove 22 therein. In addition, each guiding base 2 is mounted with a dust-proof cover 23 for sealing the first receiving groove 11 of the corresponding decorative cover 1. A connecting rod 25 is transversely fixed between the two opposing sides 24 of the two guiding bases 2 to ensure that the two guiding bases 2 stay vertical and stable (i.e., without tilting) while the guide posts 4 are slid upward and downward.

Figure 3:
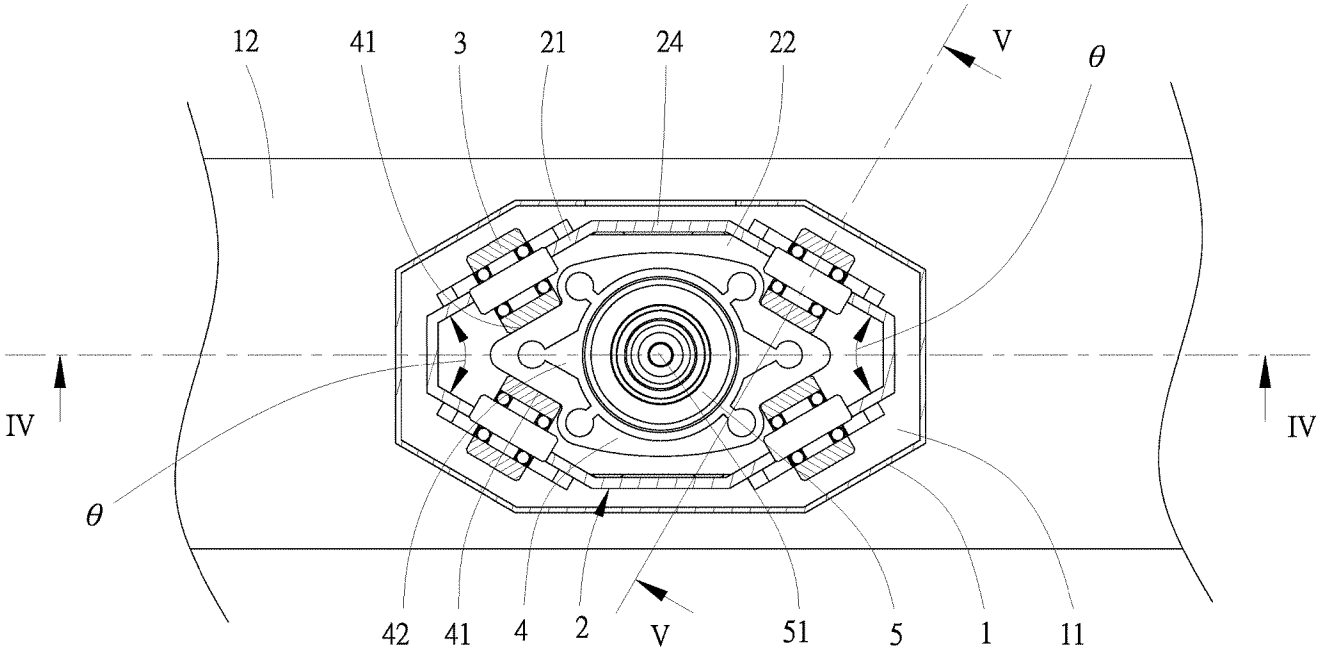
FIG. 3 is an assembled transverse sectional view of a guide post and the corresponding guide bearings in FIG. 2.
Figure 4:
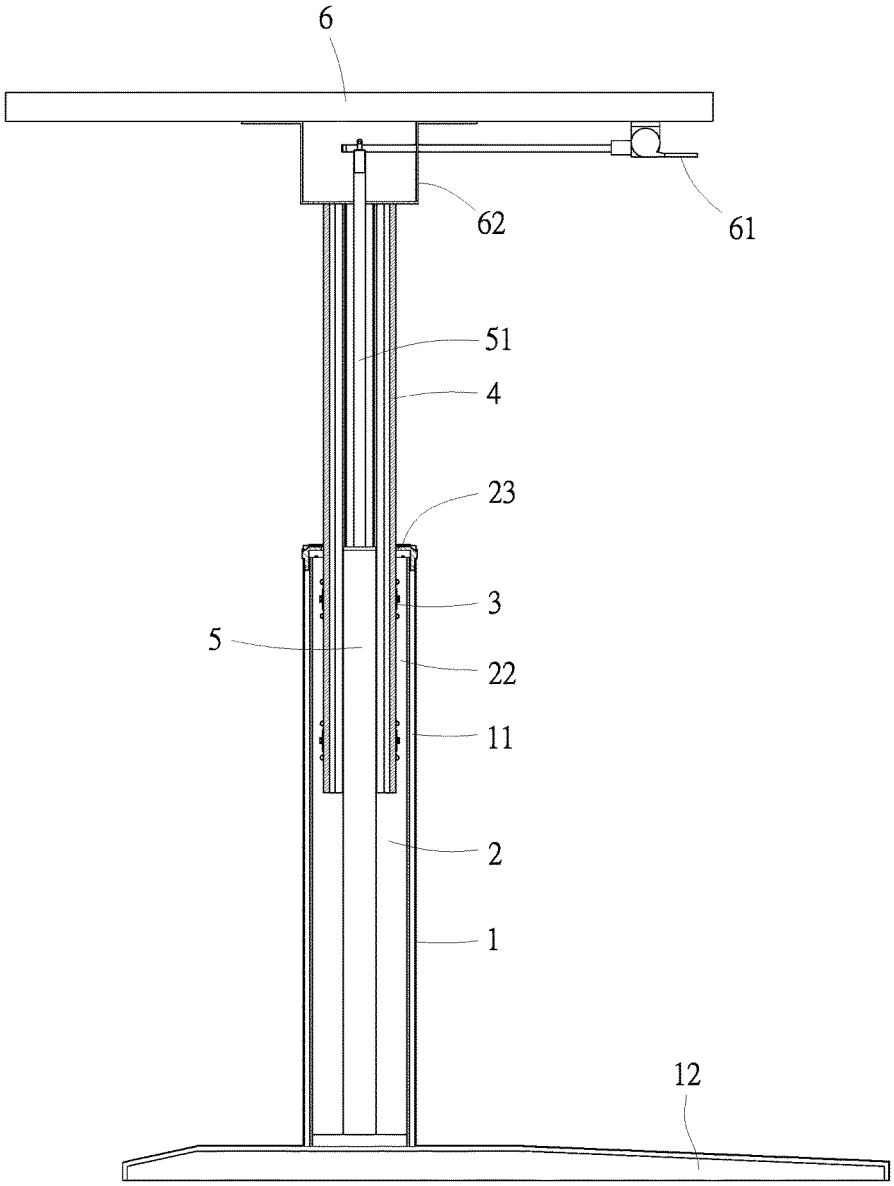
FIG. 4 is a sectional view of the embodiment in FIG. 2, taken along the line IV-IV in FIG. 3.
Figure 5:
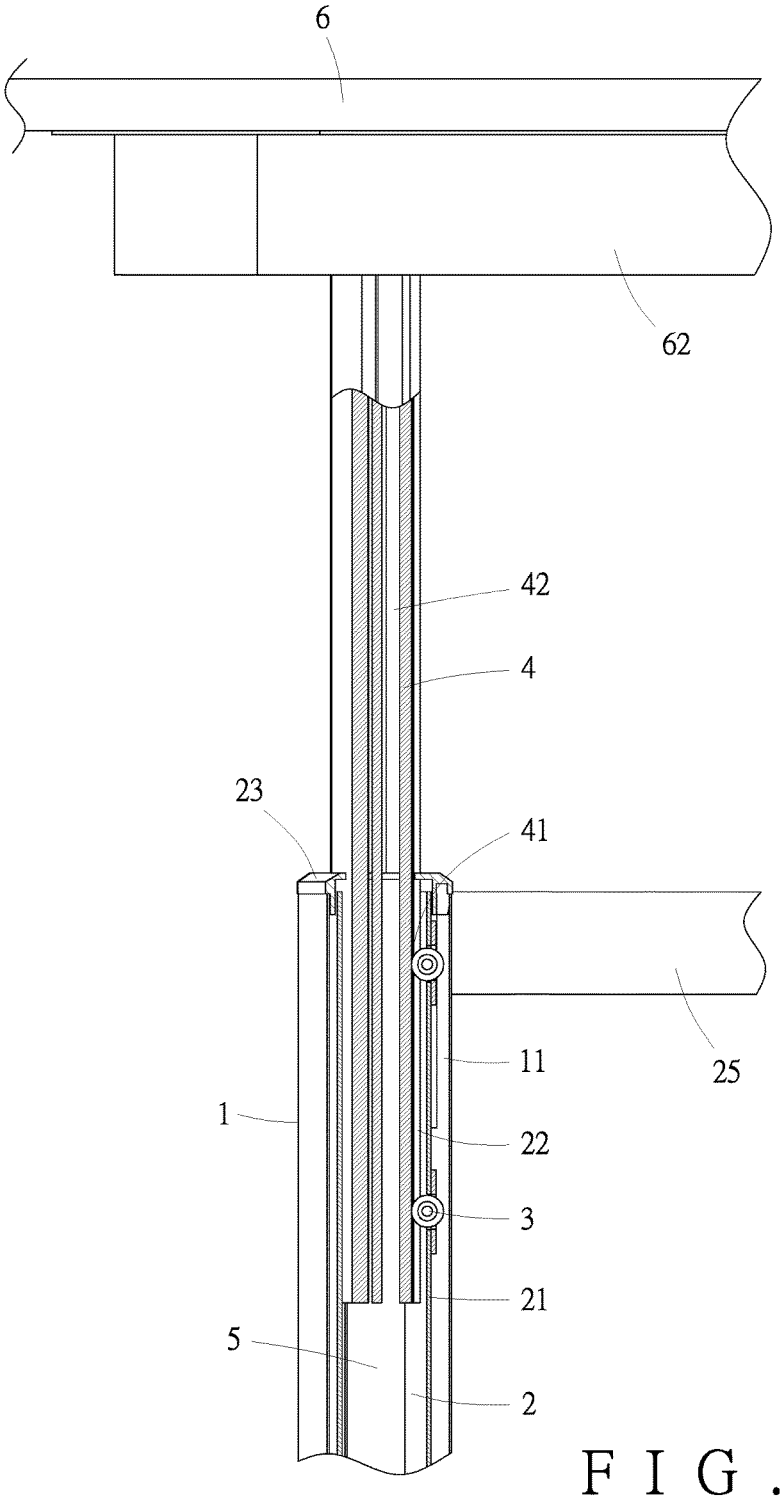
FIG. 5 is another sectional view of the embodiment in FIG. 2, taken along the line V-V in FIG. 3.

The guide bearings 3 are fixed on the fixed sides 21 of the two guiding bases 2 and may be roller bearings or ball bearings. As shown in FIG. 3, FIG. 4, and FIG. 5, the guide bearings 3 are provided in pairs, and each pair of guide bearings 3 are opposite each other and arranged at an angle $\theta$ with respect to each other, wherein the angle $\theta$ is an obtuse angle. In this embodiment, each guiding base 2 is fixedly provided with eight guide bearings 3: four in an upper row and the other four in a lower row. Each guide bearing 3 may be made entirely of metal or plastic or have a metal outer portion and a plastic inner portion to reduce the noise caused by gliding contact between the guide posts 4 and the guide bearings 3, i.e., by the guide posts 4 sliding along the guide bearings 3.

The two guide posts 4 are placed in the two second receiving grooves 22 of the two guiding bases 2 respectively. Each guide post 4 has four guided sides 41 corresponding respectively in position to the fixed sides 21 of the corresponding guiding base 2, and the guided sides 41 of each guide post 4 are in contact with the upper and lower rows of guide bearings 3 on the corresponding guiding base 2 so that the two guide posts 4 can be slid with respect to the two guiding bases 2 respectively. The guide bearings 3 on each guiding base 2 abut against the four guided sides 21 of the corresponding guide post 4 in the aforesaid pairs, i.e., with each pair of guide bearings 3 arranged opposite, and at the angle θ with respect to, each other. This arrangement is intended to preclude gaps, and hence unintended movement, between each guide post 4 and the corresponding guiding base 2. The two guide posts 4 may be extruded aluminum members, and the outer surfaces of the extruded members may further have an electrophoresis-based crystalline coating finish to prevent not only oxidation but also scratches attributable to gliding contact with the guide bearings 3. Each guide post 4 has a tubular shape and forms a third receiving groove 42 therein.

The two driving units 5 are provided in the two third receiving grooves 42 of the two guide posts 4 respectively and are fixed on the two table feet 12 respectively. Each driving unit 5 is a hydraulic or pneumatic cylinder provided with an elevating rod 51.

The tabletop 6 can be moved upward and downward with the two elevating rods 51 and the two guide posts 4 at the same time. An elevation control switch 61 is provided on a bottom portion of the tabletop 6 to control the two driving units 5, or more particularly to allow and to not allow vertical movement of the elevating rods 51. A guide post fixing base 62 is fixed on the bottom side of the tabletop 6 and is fixed at the top ends of the two guide posts 4 and of the two elevating rods 51. The elevation control switch 61 has an end portion provided in the guide post fixing base 62.

Figure 6:
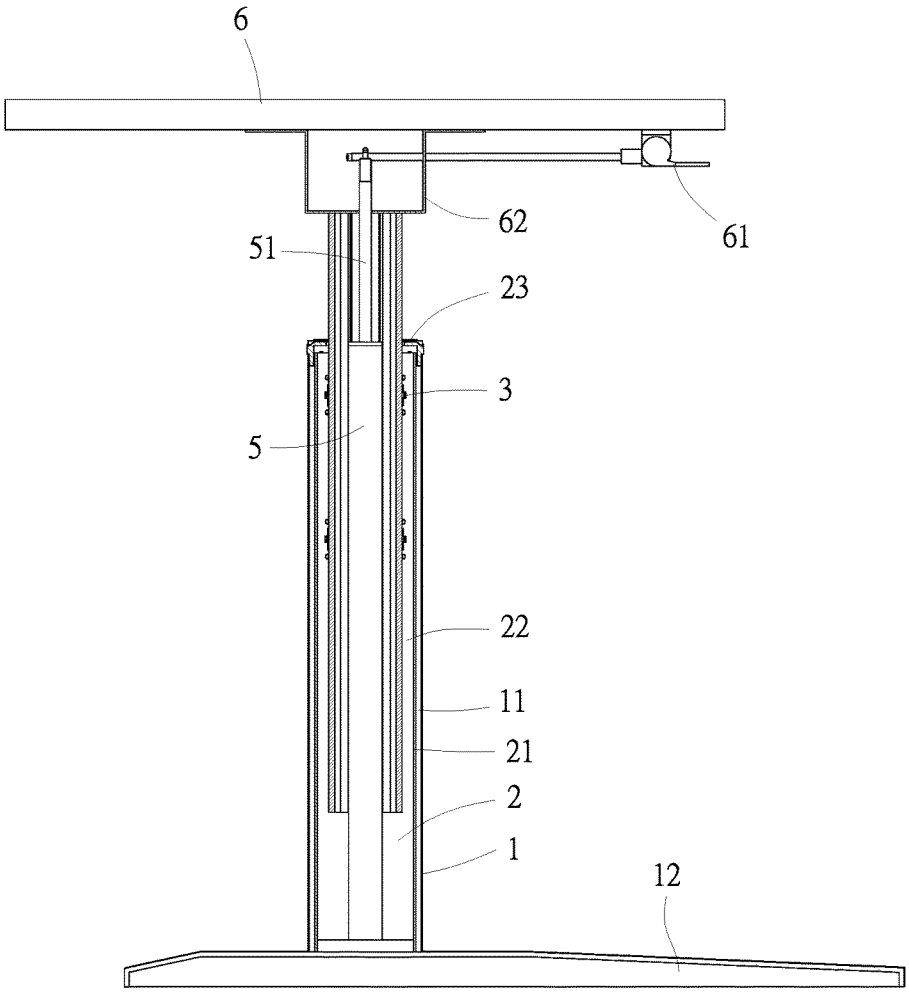
FIG. 6 shows how the embodiment in FIG. 2 is used to lower a tabletop.
Figure 7:
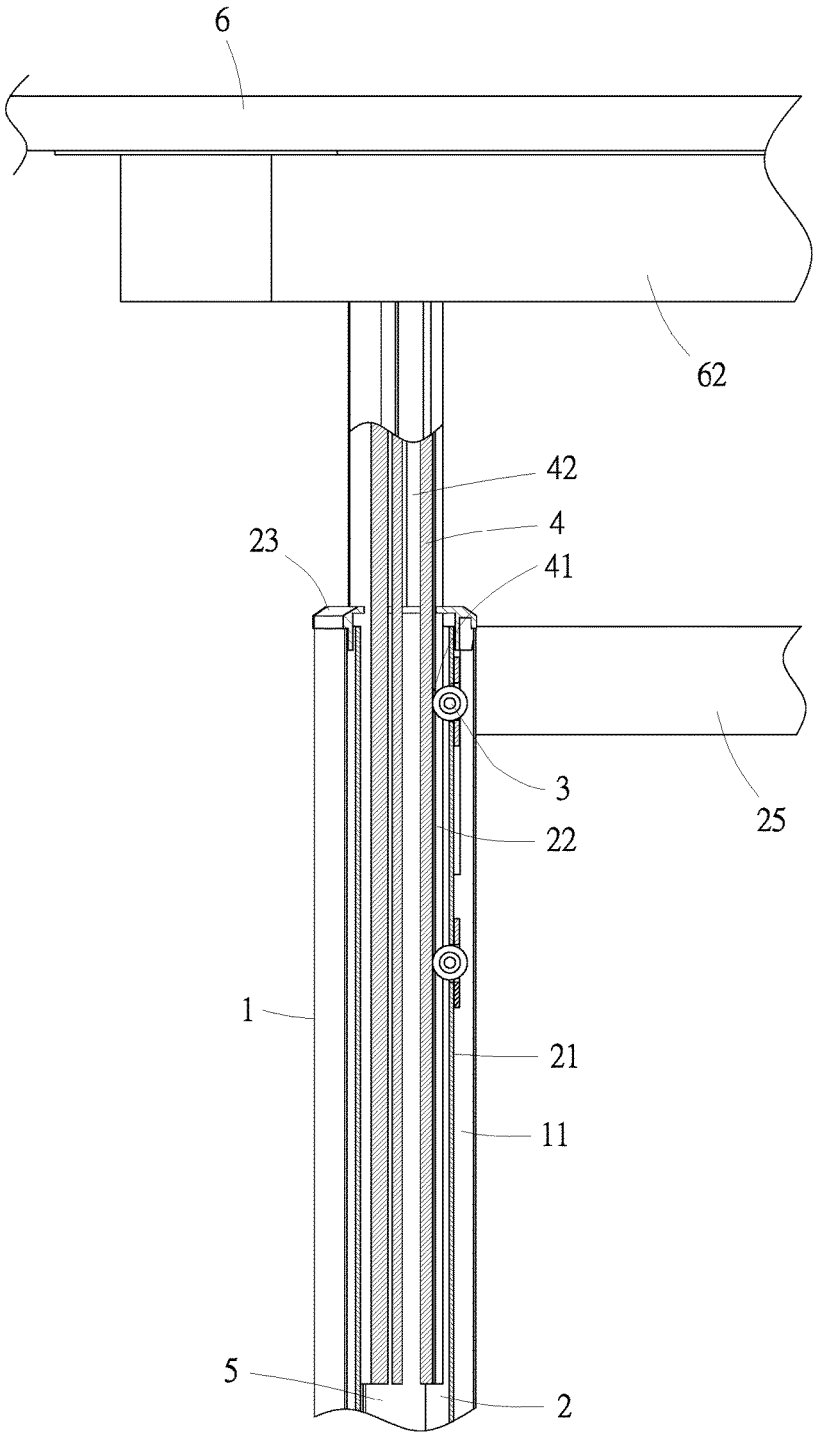
FIG. 7 is a partial assembled sectional view showing how the embodiment in FIG. 2 is used to lower a tabletop.
Figure 8:
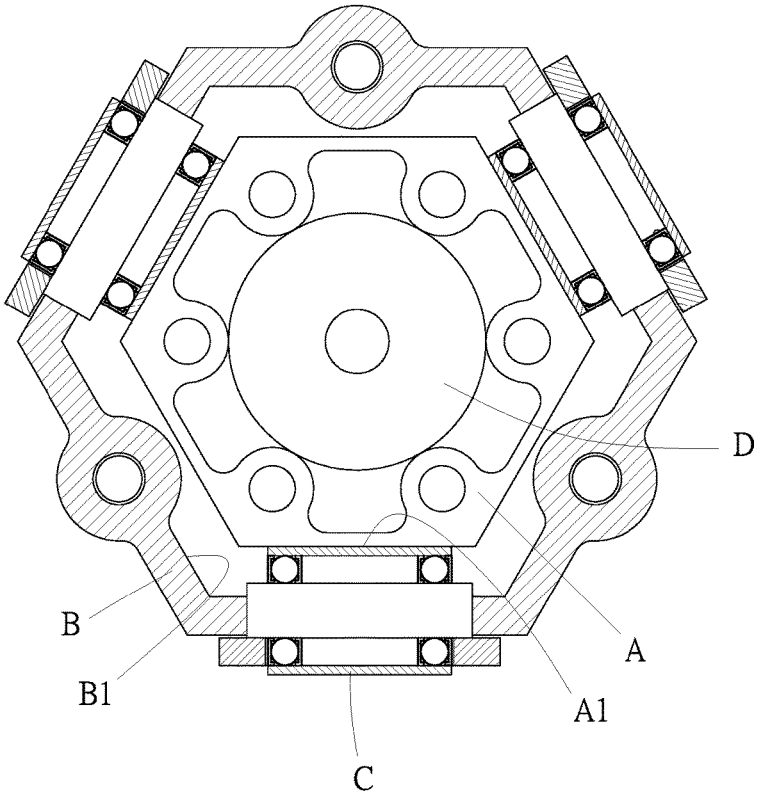
F I G . 8 (PRIOR ART)
FIG. 8 is an assembled transverse sectional view of a conventional device for table elevation.

The foregoing device for table elevation is used in the following manner. To lower the tabletop 6, referring to FIG. 6 and FIG. 7 in conjunction with FIG. 1, the first step is to press the elevation control switch 61. Then, a force is applied to retract the two elevating rods 51 of the two driving units 5 downward. As the top ends of the two elevating rods 51 and of the two guide posts 4 are all fixed to the guide post fixing base 62 on the bottom side of the tabletop 6, the two guide posts 4 and the tabletop 6 will be driven downward (i.e., lowered) by downward retraction of the two elevating rods 51. While the two guide posts 4 are descending, referring to FIG. 3, the guided sides 41 of the two guide posts 4 are in gliding contact with the guide bearings 3 on the fixed sides 21 of the two guiding bases 2, and with the guided sides 41 of each guide post 4 sliding downward along the upper and lower rows of guide bearings 3 on the corresponding guiding base 2, the upper and lower rows of guide bearings 3 on each guiding base 2 are actually supporting an upper area and a lower area of the corresponding guide post 4 respectively to keep the corresponding guide post 4 descending vertically and stably. Apart from that, the connecting rod 25 transversely fixed between the two opposing sides 24 of the two guiding bases 2 further ensures that the two guiding bases 2 will not tilt but remain vertical and stable when the two guide posts 4 are sliding downward.

Moreover, as the guide bearings 3 on each guiding base 2 are provided in pairs and abut against the guided sides 41 of the corresponding guide post 4 in the same pairs, with each pair of guide bearings 3 arranged opposite, and at the angle θ with respect to, each other, the abutting of each pair of guide bearings 3 against the corresponding guided sides 41 prevents gaps from forming between each guide post 4 and the corresponding guiding base 2 while the two guide posts 4 are slid with respect to the two guiding bases 2 respectively. Thus, not only are the two guide posts 4 kept from wobbling and getting loose with respect to the two guiding bases 2 when sliding downward, but also the guide bearings 3 are protected from being subjected to uneven force application (e.g., force application on only one side), which if occurring may lead to frictional resistance and damage of the guide bearings 3. Besides, downward slide of the guide posts 4 will be noiseless because the guide bearings 3 are made entirely of metal or plastic or have a metal outer portion and an inner plastic portion. The electrophoresis-based crystalline coating finish applied to the outer surfaces of the two guide posts 4 can reduce oxidation and protect the guide posts 4 from being scratched by gliding contact with the guide bearings 3, thereby esthetically enhancing, and extending the service life of, the guide posts 4.

When it is desired to lift the tabletop 6, the user only has to press the elevation control switch 61, and the tabletop 6 will rise automatically. The upward sliding mechanism of the two guiding bases 2, the two guide posts 4, and the guide bearings 3 is analogous to the downward sliding mechanism of the same components when lowering the tabletop 6 and therefore will not be described in detail. While the tabletop 6 ascends, the present invention brings about the same advantageous effects as stated above: the two guiding bases 2 will stay vertical and stable without tilting, resistance resulting from force application to the guide bearings 3 on only one side is prevented, noise is minimized during the sliding process, and the two guide posts 4 are protected from scratches when gliding and are hence expected to have a long service life.

A full understanding of the operation, use, and effects of the present invention can be achieved by perusal of the foregoing description of the disclosed embodiment. The embodiment, however, is only a preferred one of the invention and is not intended to be restrictive of the scope of the invention. All simple equivalent changes and modifications made according to the present specification and the appended claims should fall within the scope of patent protection sought by the applicant.

What is claimed is:

1. A device for table elevation, comprising:

two longitudinally extended guiding bases disposed in laterally spaced relationship and joined one to the other by a connecting rod, each guiding base having at least four fixed sides and a plurality of guide bearings mounted in pairs on diametrically opposing fixed sides of said guiding base;

two decorative covers respectively at least partially enclosing the two guiding bases;

two guide posts respectively telescopically received in the two guiding bases, each of the two guide posts has a plurality of guided sides equal in number and disposed in correspondence to the fixed sides of the respective guiding base into which it is telescopically received, at least a pair of the guided sides of each guide post being in contact with a corresponding pair of the guide bearings of the respective guiding base so that each of the two guide posts is slidable relative to the respective guiding base;

two driving units fixed respectively in the two guide posts, each of the two driving units being provided with an elevating rod; and a guide post fixing base fixed at top ends of the two guide posts and of the two elevating rods so as to move upward and downward simultaneously with the two elevating rods and the two guide posts.

2. The device for table elevation as claimed in claim 1, further comprising a tabletop and an elevation control switch, wherein the guide post fixing base is fixed on a bottom side of the tabletop, and the elevation control switch has an end portion provided in the guide post fixing base coupled to the two elevating rods.

3. The device for table elevation as claimed in claim 1, wherein the connecting rod is transversely fixed between two opposing sides of the two guiding bases.

4. The device for table elevation as claimed in claim 1, wherein each of the two decorative covers forms a first receiving groove therein, the two guiding bases are provided in the two first receiving grooves respectively and are fixed on two table feet respectively, and each of the two guiding bases is mounted with a dust-proof cover for sealing the first receiving groove of a corresponding one of the two decorative covers.

5. The device for table elevation as claimed in claim 4, wherein each of the two guiding bases forms a second receiving groove therein, and the two guide posts are placed in the two second receiving grooves respectively.

6. The device for table elevation as claimed in claim 5, wherein each of the two guide posts forms a third receiving groove therein, and the two driving units are provided in the two third receiving grooves respectively and are fixed on two table feet respectively.

7. The device for table elevation as claimed in claim 1, wherein each of the two guiding bases has an elongated octagonal cross-sectional contour, the elongated octagonal cross-sectional contour of each said guiding base having four alternate sides defined as the four fixed sides, and each of the four fixed sides being at an obtuse interior angle relative to an adjacent side.

8. The device for table elevation as claimed in claim 1, wherein said plurality of guide bearings is defined by eight guide bearings mounted in pairs of guide bearings on diametrically opposing fixed sides of each said guiding base, each said guiding base having two pairs of said guide bearings mounted at a first longitudinal position and the other two pairs of said guide bearings being mounted at a second longitudinal position longitudinally spaced from said first longitudinal position, and the guided sides of each said guide post are in contact with the two pairs of said guide bearings at said first longitudinal position and the two pairs of said guide bearings at said second longitudinal position of the corresponding guiding base.

9. The device for table elevation as claimed in claim 1, wherein the guide bearings are made entirely of metal, or are made entirely of plastic, or each have a metal outer portion and a plastic inner portion.

10. The device for table elevation as claimed in claim 1, wherein each of the two guide posts is an extruded aluminum member and has an outer surface with an electrophoresis-based crystalline coating finish.

* * * * *